United States Patent [19]

Burgoon

[11] Patent Number: 4,619,010

[45] Date of Patent: Oct. 28, 1986

[54] SCRUBBER WITH MECHANISM FOR AUTOMATICALLY RAISING AND LOWERING A SQUEEGEE ASSEMBLY

[75] Inventor: Jack L. Burgoon, Toledo, Ohio

[73] Assignee: Cooper Industries, Inc., Houston, Tex.

[21] Appl. No.: 783,047

[22] Filed: Sep. 30, 1985

Related U.S. Application Data

[63] Continuation of Ser. No. 596,652, Apr. 4, 1984, abandoned.

[51] Int. Cl.[4] ..... A47L 11/30

[52] U.S. Cl. ..... 15/50 R; 15/98; 15/320; 15/340; 15/361; 15/401

[58] Field of Search ..... 15/50 R, 98 R, 320, 15/340, 361, 401; 74/105, 106; 180/19.3

[56] References Cited

U.S. PATENT DOCUMENTS

| | | | |
|---|---|---|---|
| 3,823,791 | 7/1974 | Sheler | 180/19.3 |
| 4,006,506 | 2/1977 | Burgoon | 15/50 R |
| 4,293,971 | 10/1981 | Block | 15/320 |
| 4,334,335 | 6/1982 | Brown et al. | 15/320 |
| 4,483,041 | 11/1984 | Waldhauser et al. | 15/320 |
| 4,492,002 | 1/1985 | Waldhauser et al. | 15/401 |

*Primary Examiner*—Chris K. Moore

*Attorney, Agent, or Firm*—Eddie E. Scott; Alan R. Thiele

[57] ABSTRACT

A walk-behind scrubber is provided with mechanism for lowering a squeegee assembly when the scrubber is moved forwardly and for raising the squeegee assembly when the scrubber is moved rearwardly. The scrubber includes front wheels which are driven by a motor which is connected to the wheels by belts and pulleys when a moveable handle at the rear of the scrubber is pushed to move the scrubber forwardly. The motor is connected to the wheels by friction discs when the handle is pulled to move the scrubber rearwardly. When the handle is pushed, mechanism including a switch is operated to lower the squeegee assembly and when the handle is pulled, the mechanism including the switch is operated to raise the squeegee assembly.

14 Claims, 7 Drawing Figures

SCRUBBER WITH MECHANISM FOR AUTOMATICALLY RAISING AND LOWERING A SQUEEGEE ASSEMBLY

This application is a continuation of application Ser. No. 596,652, filed Apr. 4, 1984 now abandoned.

This invention relates to a walk-behind scrubber with mechanism for automatically lowering and raising a squeegee assembly when the scrubber is moved forwardly and rearwardly.

Walk-behind scrubbing machines are well known in the art. They commonly have a plurality of disc-type scrubbing brushes located under a forward portion of the machine and in generally overlapping relationship. Cleaning solution is supplied from a solution or supply tank to the disc brushes. A squeegee assembly is located under a rear portion of the machine and gathers solution and dirt which is picked up by an exhaust hose and deposited in a recovery tank. Drive wheels are frequently located between the scrubbing brushes and squeegee assembly for moving the scrubber forwardly and rearwardly. The drive wheels can be driven by an electric motor which is connected to the wheels by belts and pulleys when a moveable handle at the rear of the machine of the scrubber is pushed, to move the scrubber forwardly. The motor can be connected to the wheels by friction discs when the handle is pulled, to move the scrubber rearwardly.

When the handle is pushed, it also operates a switch which activates an electric drive in the form of a linear actuator to move a lever or rack in a manner to lower the squeegee assembly. When the handle is pulled, the switch can be operated in a manner to cause the linear actuator to move the lever or rack in a manner to raise the squeegee assembly. Thus, the squeegee assembly is automatically lowered when the scrubber is moved forwardly and automatically raised when the scrubber is moved rearwardly. The squeegee assembly is preferably affixed to a follower arm which is pivotally connected to the scrubber body. The lever or rack then engages the follower arm to raise the squeegee assembly and also to tend to center the squeegee assembly if it is off to one side before being raised.

It is, therefore, a principal object of the invention to provide a walk-behind scrubber with mechanism operated by a handle for moving the scrubber forwardly and lowering a squeegee assembly and for moving the scrubber rearwardly and raising the squeegee assembly.

Another object of the invention is to provide a scrubber with a followr-type squeegee assembly with means for automically raising and lowering the squeegee assembly and for centering the squeegee assembly when it is raised.

Many other objects and advantages of the invention will be apparent from the following detailed description of a preferred embodiment thereof, reference being made to the accompanying drawings, in which.

Figure 1:
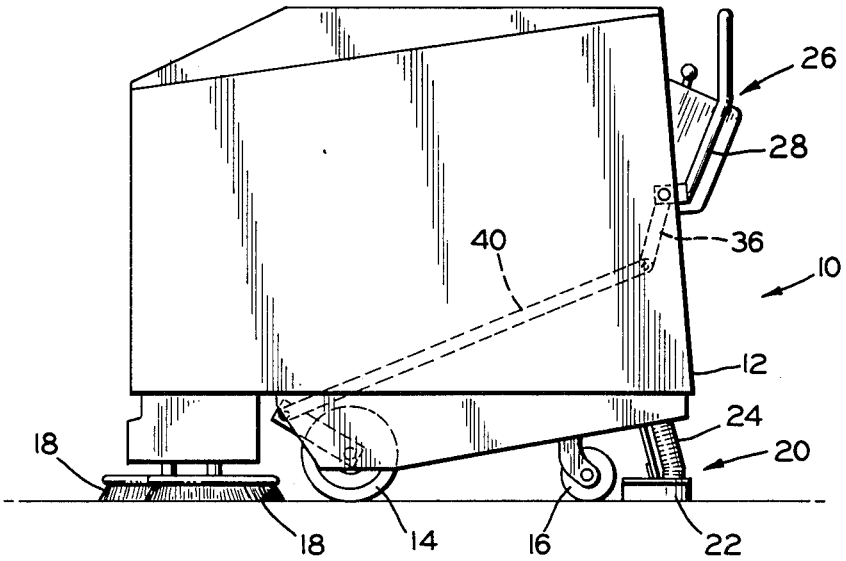
FIG. 1 is a schematic side view in elevation of a walk-behind scrubber embodying the invention.

Referring particularly to FIG. 1, a walk-behind scrubber according to the invention is indicated at 10. The scrubber 10 includes a body 12 supported on forward, driven wheels 14 and rear casters 16. Disc-type scrubbing brushes 18 are supported under a forward portion of the body 12 and are rotated by any suitable means (not shown). A squeegee assembly 20 is supported below a rear portion of the body and has squeegee blades 22 to collect solution deposited on the surface being cleaned at or near the scrubbing brushes 18. The solution and dirt, along with air, are picked up through an exhaust hose or line 24 and delivered to an upper portion of a recovery tank (not shown) in the scrubber. A supply or soluton tank (not shown) is located at the forward portion of the scrubber to supply the cleaning solution through or near the scrubbing brushes 18.

The scrubber 10 is manipulated by an operator standing behind the machine and grasping a control handle 26. The handle 26 includes two side legs 28 and 30 and an upper cross bar 32. The legs 28 and 30 are pivotally connected to the scrubber body 12 by brackets 34 and suitable pin assemblies 36. The leg 28 has a lower arm 38 below the bracket 34 which is pivotally connected to an upper, rear end of a link 40 by a suitable pin assembly 42. A lower, forward end of the link 40 has a slot 44 through which a pin assembly 46 extends. This pivotally connects the link 40 with a bracket 48, to be discussed subsequently, and an L-shaped arm 50 affixed to a pulley platform 52.

Figure 3:
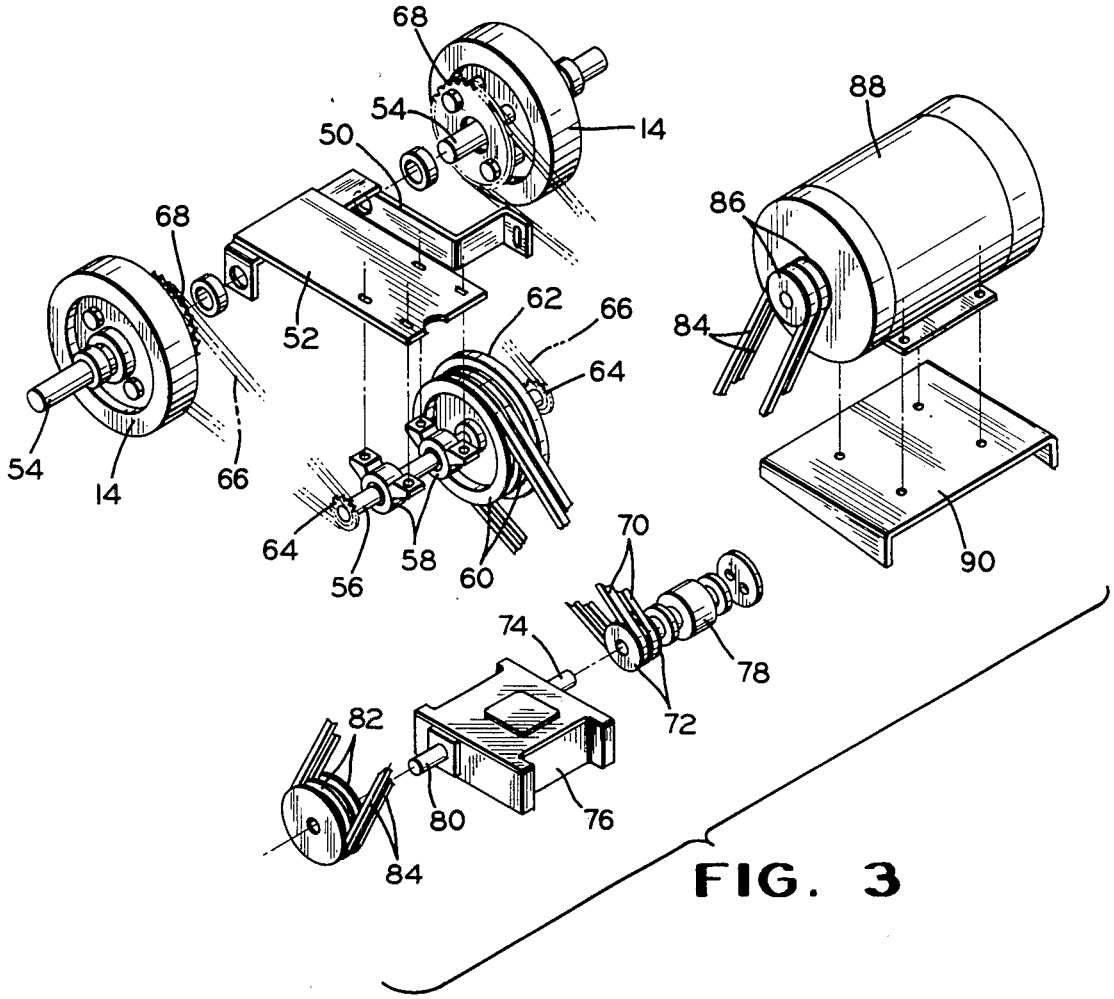
FIG. 3 is an exploded view in perspective, taken from a different angle, of certain drive components shown in FIG. 2 and additional components.

Referring more particularly to FIG. 3, the platform 52 and the arm 50 are pivotally supported by wheel shafts 54. The platform pivots up when the control handle 26 is pushed forwardly and pivots down when the control handle 26 is pulled rearwardly. An intermediate shaft 56 is rotatably supported under the platform 52 by bearings 58. The shaft 56 has two driven pulleys 60 mounted thereon and a larger driven friction disc 62 adjacent the pulleys. End sprockets 64 on the shaft 56 are connected through chains 66 to driven sprockets 68 affixed to the wheels 14 and rotate the wheels when the intermediate shaft 56 is driven. A differential (not shown) enables the sprockets 64 to rotate independently for maneuverability.

The pulleys 60 are connected through belts 70 with drive pulleys 72 affixed to an output shaft 74 of a gearbox 76. A friction drive disc or roller 78 is also mounted on the shaft 74 adjacent the pulleys 72. An input shaft 80 of the gearbox 76 is driven through pulleys 82 affixed thereon. These, in turn, are connected through belts 84 with drive pulleys 86 mounted on an output shaft of an electric motor 88 located on a suitable platform 90 within the scrubber body 12.

In operation, the output shaft 74 of the gearbox 76 is constantly rotated when the motor 88 is operating. When the scrubber is to be moved forwardly, the control handle 26 is pushed to move the link 40 rearwardly and raise the platform 52 through the arm 50. The driven pulleys 60 thereby move away from the drive pulleys 72 to tighten the belts 70. The wheels 14 are then driven in a forward direction through the intermediate shaft 56 and the sprocket trains 64, 66 and 68. When the control handle 26 is pulled rearwardly, the link 40 moves forwardly to move the platform 52 downwardly by the arm 50. This causes the pulleys 60 to move toward the pulleys 72 and thereby slacken the belt 70, with this movement continuing until the driven disc 62 engages the drive disc or roller 78. This causes the intermediate shaft 56 to rotate in the opposite direction and to drive the wheels 14 in the opposite direction through the sprocket trains. In an intermediate position of the platform 52, the belts are slack and the discs 62 and 78 are spaced apart so that no movement of the wheels 14 occurs. In actuality, the discs 62 and 78 are close together so that little movement of the platform 52 is needed to cause the intermediate shaft 56 to be driven either through the pulleys 60 or the driven disc 62.

Figure 2:
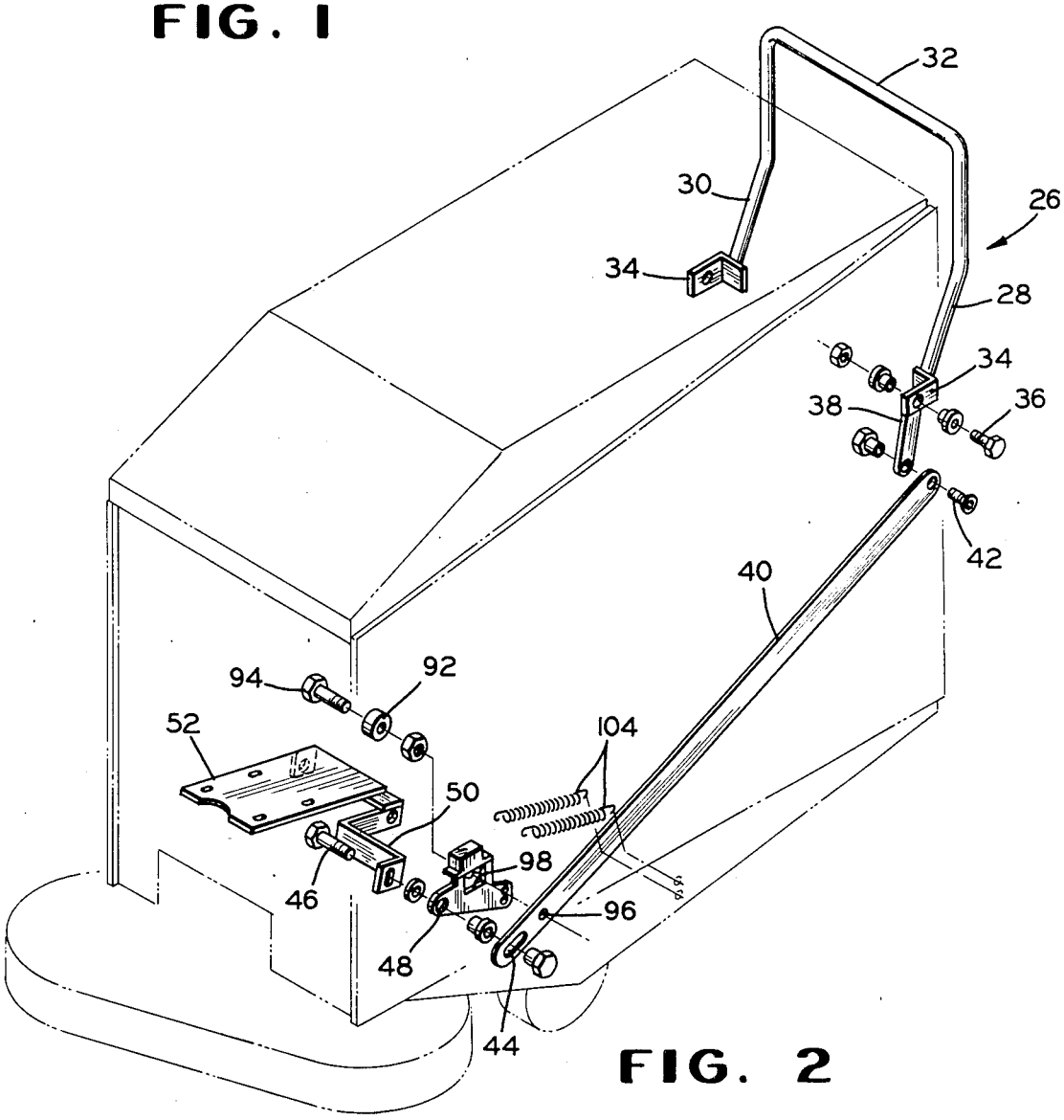
FIG. 2 is a view in perspective of the machine body shown in phantom lines and with certain drive components shown exploded.
Figure 4:
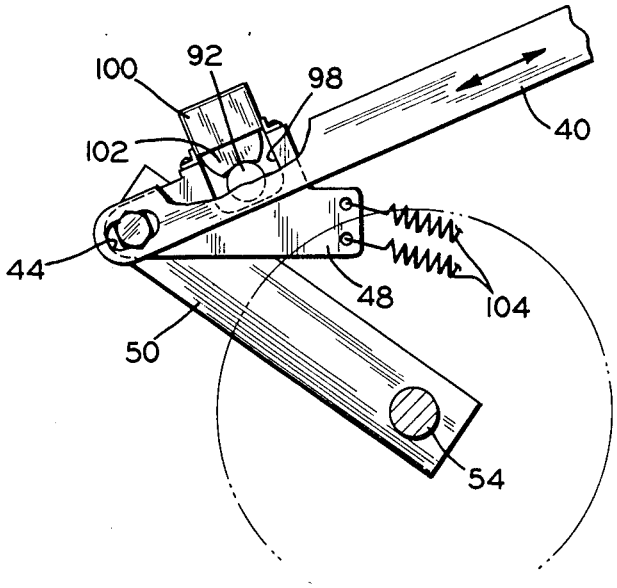
FIG. 4 is an enlarged, fragmentary view in elevation of certain components shown in FIG. 2.
Figure 5:
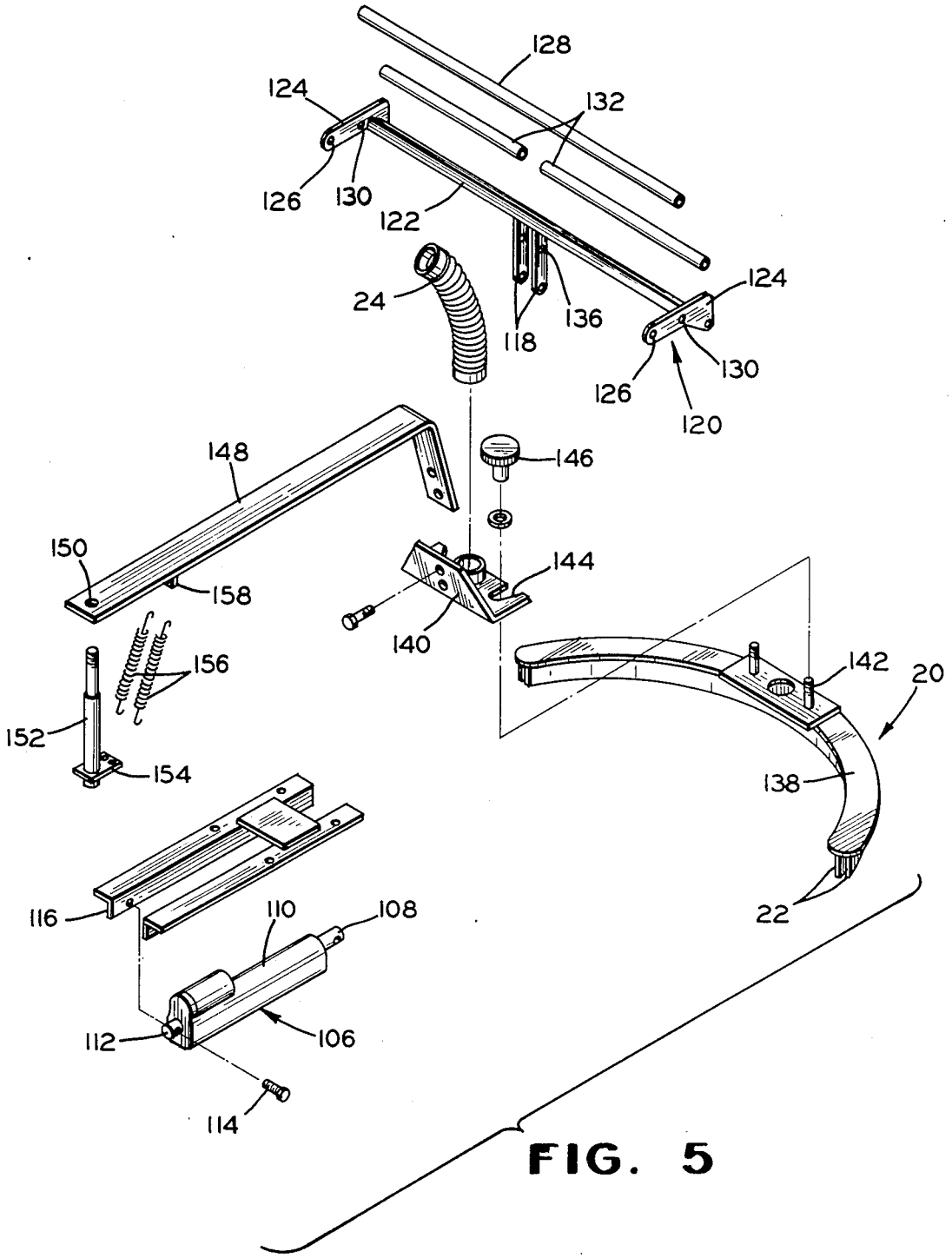
FIG. 5 is an exploded view in perspective of a squeegee assembly and mechanism for raising and lowering same.

The mechanism for raising and lowering the squeegee assembly 20 will now be discussed. Toward this purpose, a roller 92 (FIG. 2) is rotatably carried on a bolt 94 extending through an opening 96 of the link 40 adjacent to the slot 44. The roller 92 is located in a notch 98 in the bracket 48. A switch 100 is also mounted on the bracket 48 and has a pivotable actuator 102 (FIG. 4) extending into the notch 98 adjacent the roller 92. When the link 40 is initially moved rearwardly, the roller 92 moves therewith before the bracket 48 moves because of the lost motion in the slot 44. This moves the actuator 102 to actuate the switch 100 to a first condition. When the link 40 is moved forwardly, the roller 92 similarly moves and causes the actuator 102 to place the switch 100 in a second condition. Further movement of the link 40 in either direction then causes the bracket 48 to move therewith so that the roller 92 and the switch actuator 102 remain in the same relative positions during further movement of the link 40 to cause the switch 100 to remain in the first or second condition. The bracket 48 does not have a fixed pivotal position relative to the scrubber body 12 and is urged rearwardly by two coil springs 104.

The switch 100 is electrically connected to a commercially avialable linear actuator 106. The actuator has a rod 108 which moves longitudinally out of or into a housing 110, depending upon the position of the switch 100. When the actuator rod reaches either extremity of its path of travel, a limit switch opens the circuit. The actuator 106 has a rear extension 112 pivotally mounted by a pin 114 on a support bracket 116 suitably supported below the scrubber body 12. The outer end of the actuator rod 108 is pivotally connected by a pin (not shown) to lower ends of depending arms 118 of a squeegee lift rack or lever 120. The arms 118 are affixed to a transverse bar 122 of the rack which extends between end plates 124. The plates 124 are pivotally connected to sides of the machine body 12 by pins (not shown) extending through end openings 126. An upper roller 128 extends between the end plates 124 and is rotatably held by pins (not shown) extending through end plate openings 130. Two lower rollers 132 extend between the end plates 124 and the arms 118, being rotatably held by pins (not shown) in openings 134 in the plates 124 and openings 136 in the arms 118.

The squeegee assembly 20 has a housing 138 which is connected to a bracket 140 through threaded studs 142 extending through notches 144 in the bracket 140 and frictionally held by hand nuts 146. If the squeegee assembly 20 should encounter an obstacle, the assembly can be separated from the bracket 140 without damage to the squeegee assembly. The bracket 140, in turn, is affixed to a squeegee follower arm 148 of L-shaped configuration. The forward end of the arm 148 has an opening 150 through which a pivot pin 152 extends. A spring mounting plate 154 is affixed to a lower end of the pivot pin 152 and receives ends of coil springs 156 which are connected to a depending plate or flange 158 on the arm 148 to urge the arm downwardly and also to tend to center the arm. The design of the follower arm 148 and the pivotal support enables the squeegee assembly 20 to follow the scrubber properly as it moves around corners, as is disclosed more fully in my U.S. Pat. No. 4,006,506, issued Feb. 8, 1977.

Figure 6:
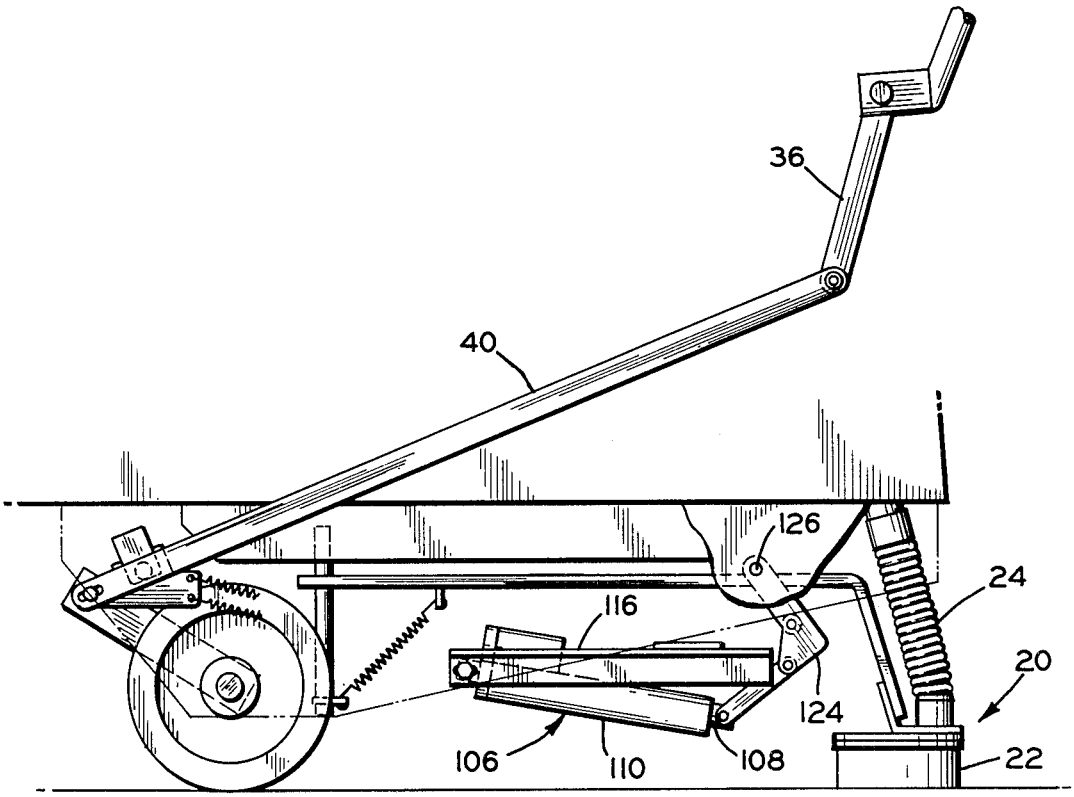
FIG. 6 is a side view in elevation of the squeegee components of FIG. 5 and handle mechanism.
Figure 7:
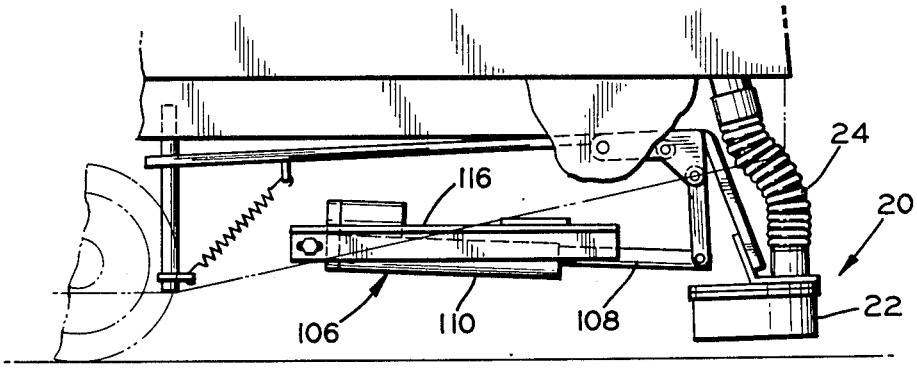
FIG. 7 is a side view in elevation of the squeegee components of FIG. 6, shown in a different position.

In the operation of the squeegee assembly lowering and raising mechanism, as the linear actuator rod 108 extends from the position of FIG. 6 to the position of FIG. 7, the roller 128 engages an intermediate portion of the follower arm 148 and raises it to lift the squeegee blades 22 off the floor, as shown in FIG. 7. If the follower arm 148 and the squeegee assembly 20 is off to one extreme side or the other when the squeegee assembly is raised, one of the rollers 132 can contact the slanted portion of the follower arm 148 to cause the follower arm and the squeegee assembly to move toward the center position as the squeegee is raised. Hence, the squeegee assembly will be centered by the time it reaches its fully raised position, even if it is off to one side when in contact with the floor.

From the above, it can be seen that the control handle and mechanism will cause the squeegee blades 22 to contact the floor by the time the platform 52 is raised sufficiently to tighten the belts 70 between the pulleys 60 and 72. Similarly, the mechanism will cause the squeegee blades 22 to be raised from the floor, out of contact therewith, by the time the platform 52 is lowered sufficiently to cause the driven disc 62 to engage the drive disc or roller 78.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. A walk-behind scrubber comprising:

a body;

wheels supporting said body above a floor;

a scrub brush at a forward portion of said body;

a squeegee assembly at a rear portion of said body;

mechanical means including electrically driven means for raising and lowering said squeegee assembly, said mechanical means including a follower arm connected to said squeegee assembly and pivotally connected to said body, a pivotable lift rack engageable with said follower arm when said squeegee assembly is raised, said pivotable lift rack being connected to said electrically driven means and having a roller extending transversely of said scrubber which engages said follower arm when said squeegee assembly is raised;

a switch connected with said electrically driven means having a first condition in which said mechanical means is moved to raise said squeegee assembly and a second condition in which said mechanical means is moved to lower said squeegee assembly;

handle means movably mounted on a rear portion of said body; and means including link means connected to said handle means and engageable with said switch to cause said switch to be in its second condition when said handle means is manipulated to move said scrubber forwardly and to cause said switch to be in its first condition when said handle means is manipulated to move said scrubber rearwardly.

2. A walk-behind scrubber according to claim 1 characterized by forward means for driving at least one wheel to move said scrubber in a forward direction, reverse means for driving at least one wheel to move said scrubber in a rearward direction, means for connecting said forward drive means to the associated wheel when said switch is in the second condition, and means for connecting said reverse drive means to the associated wheel when said switch is in the first condition.

3. A walk-behind scrubber according to claim 1 characterized by said pivotable lift rack having second rollers for engaging said follower arm when said squeegee assembly is to one side of said scrubber and said mechanical means is moved to raise said squeegee assembly.

4. A walk-behind scrubber comprising:

a body;

wheels supporting said body above a floor;

a scrubbing brush at a forward portion of said body;

a squeegee assembly at a rear portion of said body;

a drive motor;

forward means for connecting said drive motor to at least one of said wheels for moving said scrubber in a forward direction;

reverse means for connecting said drive motor to at least one of said wheels for moving said scrubber in a rearward direction;

raising and lowering means for raising and lowering said squeegee assembly;

a follower arm connected to said squeegee assembly and pivotably supported for horizontal movement by said body, said raising and lowering means engaging said follower arm when raising and lowering said squeegee assembly;

said raising and lowering means having transverse means extending transversely of said scrubber for urging said follower arm and said squeegee assembly toward a center position, if off center with respect to said scrubber, when raising said squeegee assembly;

handle means movably mounted on a rear portion of said body; and connecting means connecting said handle means with said forward and reverse means and with said raising and lowering means to cause said raising and lowering means to lower said squeegee assembly and to connect said forward means with said motor and the associated wheel when said handle means is manipulated to move said scrubber forwardly, and to cause said raising and lowering means to raise said squeegee assembly and to connect said reverse means with said motor and the associated wheel when said handle means is manipulated to move said scrubber rearwardly.

5. A walk-behind scrubber according to claim 4 characterized by said handle means being pivotally mounted on the rear portion of said body.

6. A walk-behind scrubber according to claim 4 characterized by said raising and lowering means comprising electrically driven means and switch means for operating said electrically driven means.

7. A walk-behind scrubber according to claim 4 characterized by said switch means being actuated to cause said raising and lowering means to lower said squeegee assembly before said forward means connect said motor and the associated wheel for causing said raising and lowering means to raise said squeegee assembly before said reverse means connect said motor and the associated wheel.

8. A scrubber comprising:

a body;

wheels supporting said body above a floor;

a scrub brush at a forward portion of said body;

a squeegee assembly at a rear portion of said body;

a follower arm connected to said squeegee assembly and pivotally supported for horizontal movement by said body;

a lift rack movably supported by said body and engageable with said follower arm for raising and lowering said squeegee assembly, said lift rack having a roller extending transversely of said scrubber which engages said follower arm when said squeegee assembly is raised;

electrically-driven means connected to said lift rack for moving same;

a switch connected with said electrically-driven means having a first condition in which said lift rack is moved in a manner to raise said squeegee assembly and a second condition in which said lift rack is moved in a manner to lower said squeegee assembly; and movable means to cause said switch to be in its second condition when said scrubber is to be moved forwardly and to cause said switch to be in its first condition when said scrubber is to be moved rearwardly.

9. A scrubber according to claim 8 characterized by said electrically-driven means comprising a linear actuator pivotally connected to said lift rack.

10. A walk-behind scrubber according to claim 8 characterized by said rack having second rollers for engaging said follower arm when said squeegee assembly is to one side of said scrubber and when said squeegee assembly is to be raised.

11. A walk-behind scrubber according to claim 10 characterized by said follower arm having a downwardly-extending portion connected to said squeegee assembly, said second rollers engaging said downwardly-extending portion when said squeegee assembly is to one side of said scrubber when said squeegee assembly is to be raised.

12. A scrubber according to claim 8 characterized by said movable means comprising handle means movably mounted on said scrubber body.

13. A scrubber according to claim 12 characterized by link means connected to said handle means and engagable with said switch to cause said switch to be in its second condition when said handle means is manipulated to move said scrubber forwardly and to cause said switch to be in its first condition when said handle means is manipulated to move said scrubber rearwardly.

14. A scrubber according to claim 8 characterized by a drive motor, forward means for connecting said drive motor to at least one of said wheels from moving said scrubber in a forward direction, and reverse means for connecting said drive motor to at least one of said wheels for moving said scrubber in a rearward direction, said forward and reverse means being operated by said movable means.

* * * * *